US009260871B2

(12) United States Patent
Shaw

(10) Patent No.: US 9,260,871 B2
(45) Date of Patent: Feb. 16, 2016

(54) SYSTEM, METHOD AND APPARATUS FOR TRIM FOR BUILDING PRODUCTS

(71) Applicant: CertainTeed Corporation, Valley Forge, PA (US)

(72) Inventor: Robert D. Shaw, Parma, MI (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/449,244

(22) Filed: Aug. 1, 2014

(65) Prior Publication Data

US 2015/0040510 A1 Feb. 12, 2015

Related U.S. Application Data

(60) Provisional application No. 61/864,102, filed on Aug. 9, 2013.

(51) Int. Cl.

| | |
|---|---|
| ***E04F 19/02*** | (2006.01) |
| ***E04F 19/06*** | (2006.01) |
| ***E04F 19/04*** | (2006.01) |
| ***E06B 1/60*** | (2006.01) |
| ***E04F 13/24*** | (2006.01) |
| ***E04F 13/26*** | (2006.01) |

(52) U.S. Cl.

CPC ..... *E04F 19/061* (2013.01); *E04F 13/24* (2013.01); *E04F 13/26* (2013.01); *E04F 19/0463* (2013.01); *E04F 19/0468* (2013.01); *E06B 1/6015* (2013.01); *E04F 2019/0431* (2013.01)

(58) Field of Classification Search

CPC ... E04F 19/0463; E04F 19/0495; E04F 19/02; E04F 19/0468; E04F 19/061; E04F 2019/0413; E04F 2019/0422; E04F 2019/0431; E04F 11/166; E04F 13/081; E04F 13/0835; E04F 13/24; E04F 19/0436; E04F 13/21; E04F 13/26; E04F 13/072; E06B 1/08; E06B 1/6015

USPC ..... 52/204.53, 204.54, 211, 212, 287.1, 52/288.1, 716.4, 717.01, 718.01, 718.04, 52/290, 506.05, 512, 489.1, 489.2

See application file for complete search history.

(56) References Cited

U.S. PATENT DOCUMENTS

| | | | | |
|---|---|---|---|---|
| 3,139,703 A | | 7/1964 | Hilt | |
| 3,757,483 A | | 9/1973 | Torbett | |
| 4,840,002 A | | 6/1989 | Lovgren | |
| 5,090,174 A | | 2/1992 | Fragale | |
| 5,222,343 A | * | 6/1993 | Anderson | 52/718.04 |
| 5,224,610 A | * | 7/1993 | Veazey | 211/87.01 |

(Continued)

FOREIGN PATENT DOCUMENTS

| | | | |
|---|---|---|---|
| FR | 2938862 A1 | * | 5/2010 |
| WO | 2005083196 A1 | * | 9/2005 |

*Primary Examiner* — Robert Canfield

(74) *Attorney, Agent, or Firm* — Abel Law Group, LLP; Alexander H. Plache

(57) ABSTRACT

A trim assembly may include a starter strip having a first fastener hem configured to receive a fastener, a starter flange extending from the first fastener hem, and a first rib extending from the starter flange. A fastener flange having a second fastener hem may be configured to receive a second fastener. The fastener flange can include a second rib extending from the second fastener hem. A trim having a first slot may be configured to receive the first rib and be mounted to the starter strip, and a second slot configured to receive the second rib and be mounted to the fastener flange.

18 Claims, 6 Drawing Sheets

(56) References Cited

U.S. PATENT DOCUMENTS

| | | | | |
|---|---|---|---|---|
| 5,379,561 | A | 1/1995 | Saito | |
| 5,473,851 | A | 12/1995 | Northrup, Jr. | |
| 5,678,367 | A | 10/1997 | Kline | |
| 5,706,623 | A * | 1/1998 | Brown | 52/718.04 |
| 5,850,717 | A | 12/1998 | Schiedegger et al. | |
| 6,112,481 | A | 9/2000 | Schiedegger et al. | |
| 6,148,584 | A * | 11/2000 | Wilson | 52/717.01 |
| 6,219,980 | B1 * | 4/2001 | Peck, Jr. | 52/288.1 |
| 6,272,797 | B1 | 8/2001 | Finger | |
| 6,287,046 | B1 * | 9/2001 | Neuhofer, Jr. | 403/382 |
| 6,393,779 | B1 * | 5/2002 | Boldt | 52/210 |
| 6,482,500 | B1 | 11/2002 | Diginosa | |
| 6,560,944 | B1 * | 5/2003 | Wilson | 52/717.01 |
| 6,745,523 | B2 * | 6/2004 | Petta | 52/213 |
| 6,904,726 | B2 | 6/2005 | Heard et al. | |
| 7,111,433 | B2 * | 9/2006 | Kerscher | 52/212 |
| 7,454,865 | B2 * | 11/2008 | Kerscher | 52/204.1 |
| 8,104,241 | B2 | 1/2012 | Andres | |
| 8,266,865 | B2 * | 9/2012 | Neuhofer, Jr. | 52/716.8 |
| 8,375,660 | B2 | 2/2013 | Nolan et al. | |
| 2002/0059760 | A1 * | 5/2002 | Heard et al. | 52/211 |
| 2003/0121226 | A1 * | 7/2003 | Bolduc | 52/391 |
| 2003/0145538 | A1 * | 8/2003 | Kerscher | 52/212 |
| 2003/0145539 | A1 * | 8/2003 | Knipe | 52/220.7 |
| 2005/0262798 | A1 * | 12/2005 | Pringle et al. | 52/718.04 |
| 2006/0080925 | A1 * | 4/2006 | Rossetti | 52/466 |
| 2006/0096203 | A1 * | 5/2006 | Weinstein | 52/288.1 |
| 2006/0260247 | A1 | 11/2006 | Monteer | |
| 2007/0068098 | A1 | 3/2007 | de Briere et al. | |
| 2007/0094958 | A1 | 5/2007 | Rogers | |
| 2009/0013636 | A1 * | 1/2009 | Wilson | 52/718.01 |
| 2009/0071089 | A1 * | 3/2009 | Neuhofer, Jr. | 52/469 |
| 2010/0018145 | A1 * | 1/2010 | Ellis | 52/312 |
| 2012/0328823 | A1 | 12/2012 | Monteer | |
| 2013/0047532 | A1 * | 2/2013 | Armacost | 52/288.1 |

* cited by examiner

SYSTEM, METHOD AND APPARATUS FOR TRIM FOR BUILDING PRODUCTS

This application claims priority to and the benefit of U.S. Prov. Pat. App. No. 61/864,102, filed Aug. 9, 2013, and is incorporated herein by reference in its entirety.

BACKGROUND OF THE INVENTION

1. Field of the Disclosure

The present invention relates in general to building products and, in particular, to a system, method and apparatus for trim for building products, such as trim for siding on the sides of a building.

2. Description of the Related Art

Conventional trim products are typically installed with fasteners through the face of the product. This can be done with nails or screws, the heads of which must be concealed so they are not visible from an exterior of the building. Manufacturers usually recommend several alternatives to hide the fasteners after they have been installed. Each solution requires additional labor, and the remaining aesthetics of concealing the fasteners may not match the color of the trim. Accordingly, continued improvements in trim designs are desirable.

SUMMARY

Embodiments of a trim assembly may include a starter strip having a first fastener hem configured to receive a fastener, a starter flange extending from the first fastener hem, and a first rib extending from the starter flange. A fastener flange having a second fastener hem may be configured to receive a second fastener. The fastener flange can include a second rib extending from the second fastener hem. A trim having a first slot may be configured to receive the first rib and be mounted to the starter strip, and a second slot configured to receive the second rib and be mounted to the fastener flange.

In another embodiment, a trim assembly can include a starter strip having a first fastener hem configured to receive a fastener, a starter flange extending forward from the first fastener hem, and a first rib extending from the starter flange and substantially parallel to the first fastener hem. The trim assembly can have a fastener flange having a second fastener hem configured to receive a fastener, and a second rib extending from and substantially perpendicular to the second fastener hem. A trim having a side with a first slot may be configured to receive the first rib and be mounted to the starter strip, and a back with a second slot configured to receive the second rib and be mounted to the fastener flange.

In another aspect, a trim assembly can include a starter strip having a first fastener hem and a first rib; a fastener flange having a second fastener hem and a second rib; and a trim having a first slot configured to frictionally receive the first rib and be mounted to the starter strip, and a second slot configured to frictionally receive the second rib and be mounted to the fastener flange, and no fasteners join the trim to the starter strip and the fastener flange.

Still another embodiment of a trim assembly may include a starter strip having a first fastener hem configured to be mounted to a building with fasteners; and a trim having a first slot configured to receive a portion of the starter strip by frictional engagement, the trim has a second fastener hem configured to be mounted to the building with fasteners, and no fasteners join the trim to the starter strip.

Embodiments of a method of installing trim can include installing a starter strip with fasteners on a building; installing a fastener flange on a trim without fasteners to form a pre-assembly; installing the pre-assembly on the starter strip without fasteners; and then fastening the fastener flange to the building with fasteners to form a final assembly.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments as understood by those of ordinary skill in the art.

The use of the same reference symbols in different drawings indicates similar or identical items.

DETAILED DESCRIPTION

Figure 1:
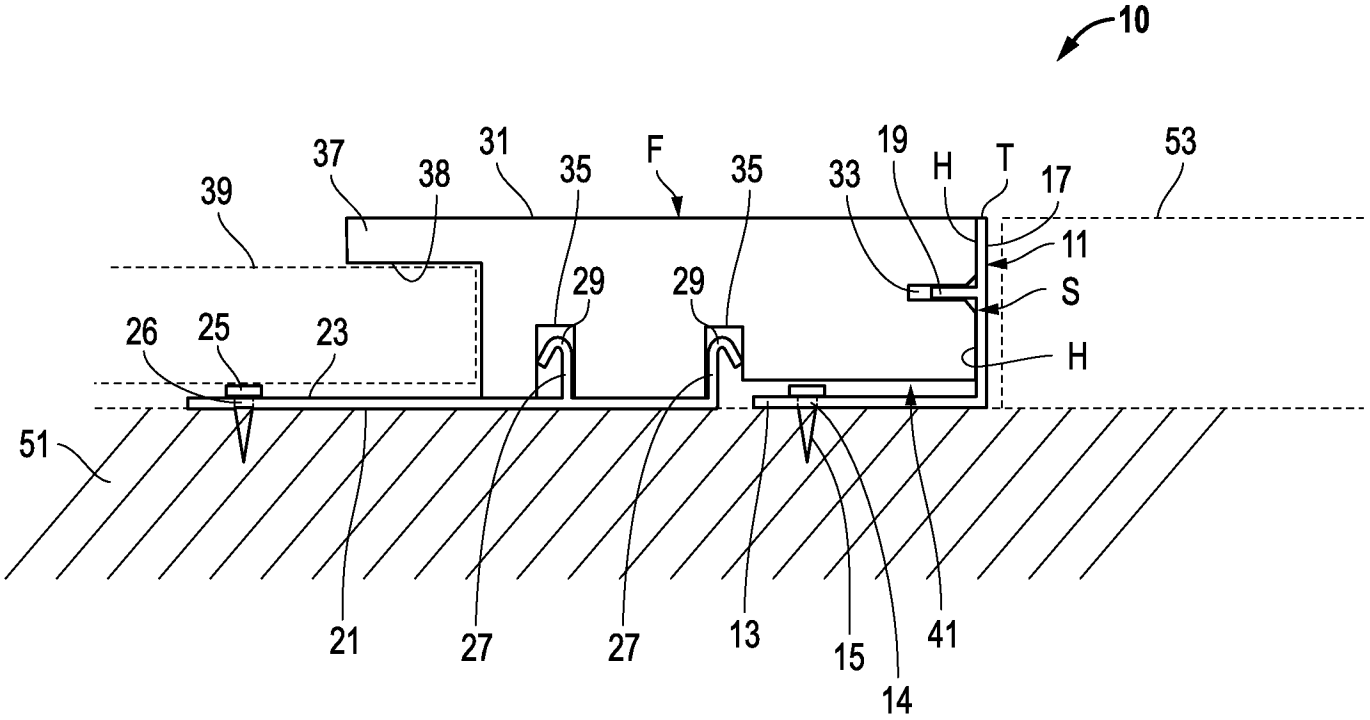
FIG. 1 is a side view of an embodiment of a trim assembly installation on a building.

Embodiments of a system, method and apparatus for building product trim are disclosed. For example, as shown in FIGS. 1-7, a trim assembly 10 may comprise a starter strip 11. The starter strip 11 (FIGS. 2A and 2B) can have a first fastener hem 13. The first fastener hem 13 may be provided with one or more holes 14 (e.g., such as the elongated slots shown) that are configured to receive one or more first fasteners 15 (e.g., screws, nails, etc.). The starter strip 11 may include a starter flange 17 extending from the first fastener hem 13. As shown in the illustrated embodiment, the starter flange 17 may be substantially perpendicular to the first fastener hem 13. Versions of the starter flange 17 may have a thickness that is substantially similar, or even identical, to that of the first fastener hem 13.

The starter strip 11 also may include a first rib 19 extending therefrom. The first rib 19 can be substantially planar. The first rib 19 can be substantially perpendicular to the starter flange 17. The first rib 19 can be substantially parallel to the first fastener hem 13. Versions of the first rib 19 may have a thickness that is substantially similar, or even identical, to that of the first fastener hem 13 and the starter flange 17.

Figure 2A:
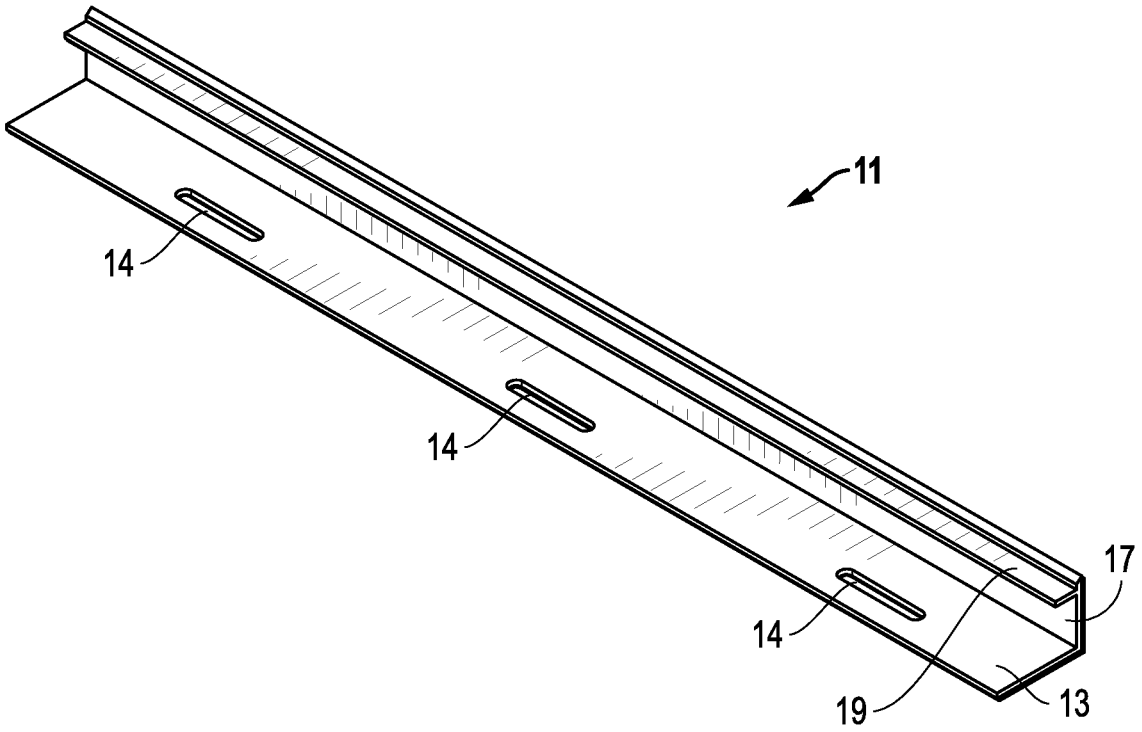
FIGS. 2A and 2B are isometric and side views of an embodiment of a starter strip for a trim assembly.
Figure 2B:
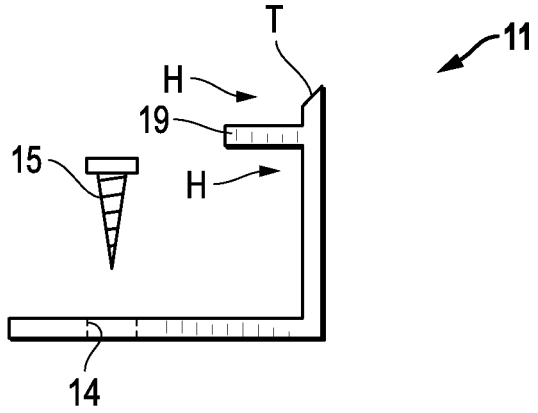

Versions of the starter strip 11 may include a distal end or tip T (FIG. 2B) on the starter flange 17. The tip T may protrude beyond the first rib 19. The tip T may be chamfered, as shown in FIGS. 2A and 2B. Starter flange 17 can include two shoulders H located on either side of the first rib 19.

Figure 3A:
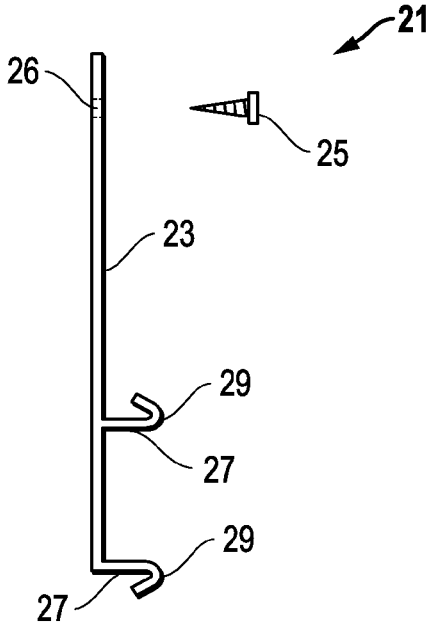
FIGS. 3A and 3B are side and front views of an embodiment of a fastener flange for a trim assembly.
Figure 3B:
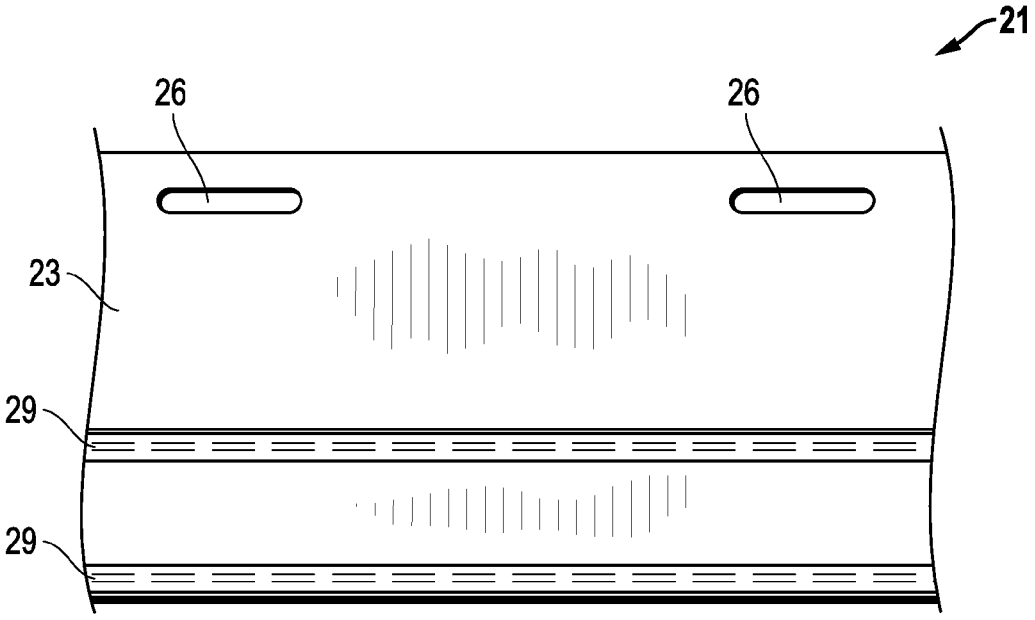

Embodiments of the trim assembly 10 may include a fastener flange 21 (FIGS. 3A and 3B). The fastener flange 21 can include a second fastener hem 23. The second fastener hem 23 may be provided with one or more holes 26 (e.g., such as the elongated slots shown) that are configured to receive one or more second fasteners 25. Fasteners 25 may be the same as or different than fasteners 15.

Some embodiments of the fastener flange may include one or more second ribs 27 (e.g., two shown). The second rib 27 can extend from the second fastener hem 23. The second rib 27 can be substantially perpendicular to the second fastener hem 23. Versions of the second rib 27 may have a thickness that is substantially similar, or even identical, to that of the second fastener hem 23.

Figure 4A:
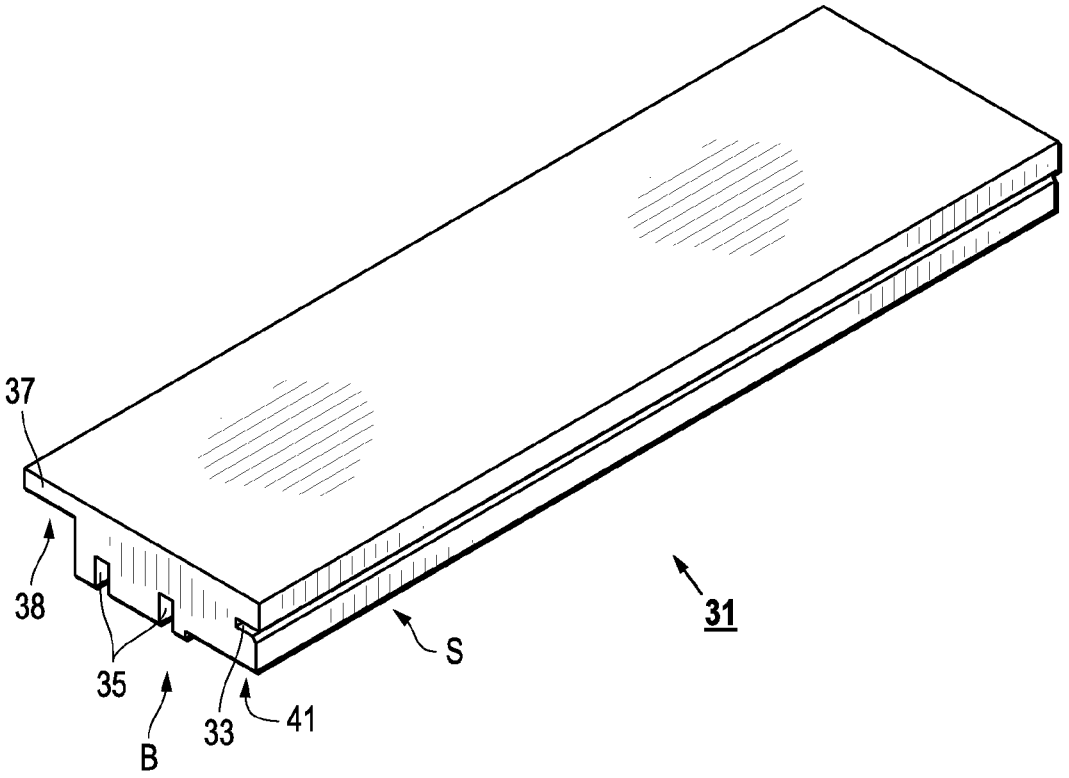
FIGS. 4A and 4B are isometric and side views of an embodiment of a trim for a trim assembly.
Figure 4B:
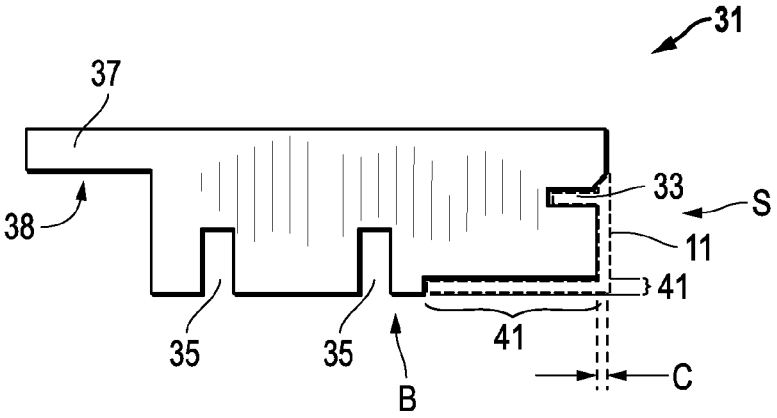

Embodiments of the trim assembly 10 may further include a trim 31 (FIGS. 4A and 4B). The trim 31 may include a side S with a first recess or slot 33. First slot 33 can be configured to receive the first rib 19. First slot 33 may be chamfered, as shown. The chamfer may be formed on one or both sides of first slot 33. Versions of trim 31 may be mounted to the starter strip 11. In some embodiments, the trim 31 can be mounted to the starter strip 11 without any fasteners.

Versions of side S may or may not be flush on either side of first slot 33. In the version of FIG. 4B, a clearance C is provided between the two portions of side S. When trim 31 is installed, clearance C can help keep the starter strip 11 flush with an end of the trim. Thus, clearance C can help avoid potential gaps between the trim and a window or other location on a building.

In the version of FIG. 1, the two portions of side S are flush such that no clearance is provided therebetween. In this latter version, the two portions of side S abut both shoulders H on starter strip 11. The tip T of starter strip 11 may or may not be flush with the outer surface or front F of trim 31.

Embodiments of trim 31 can include one or more second slots 35. The second slot 35 can be configured to receive the second rib 27. In an embodiment, a plurality of second slots 35 individually and respectively receive a plurality of the second ribs 27. Versions of trim 31 can be mounted to the fastener flange 21. See, e.g., the example of FIG. 6.

Other versions of the trim 31 may further comprise a fastener recess 41 (FIG. 1) configured to accommodate a head of the fastener 15 of the starter strip 11. The fastener recess 41 can be located adjacent the second slot 35, and may comprise a small clearance. In the embodiment of FIG. 1, the recess 41 is contiguous with the second slot 35. In the embodiment of FIGS. 4A and 4B, the recess 41 is separated from the second slot 35 by a small protrusion.

In the embodiment of starter strip 11 shown in phantom in FIG. 4B, the length of its starter flange 17 may be shortened, such that it terminates at first slot 33 as shown. In some versions, starter flange 17 is completely located within the clearance C, such that the back side of starter flange 17 is flush with the side S of trim 31, as shown. Similarly, the first fastener hem 13 of starter strip 11 can reside within fastener recess 41 such that it is flush with back side B.

Some embodiments of the second rib 27 can be non-planar. The second rib 27 can include a lip 29. The lip 29 can be located at a distal end of the second rib 27. The lip 29 can have a shape, such as a hook, a curve, a J-lip, a U-lip, etc. Such a shape can facilitate both frictional and mechanical engagement between the second rib 27 and the second slot 35. Alternately, mechanical fasteners or adhesive may be used to secure the components together.

Embodiments of the lip 29 can accommodate a difference or variance in a width of the second slot 35. For example, if the second slot 35 is relatively narrow, the lip 29 can rotate to provide more engagement with the second slot 35. In the embodiments of a plurality of the second ribs 27, the second ribs 27 can extend in a same direction. The second ribs 27 can have opposed features (e.g., lips 29) at distal ends thereof. The second ribs 27 may be opposed in the sense that they extend at least partially in opposite directions.

In some versions, the trim 31 can be mounted to the fastener flange 21 without any fasteners. The first and second ribs 19, 27 can engage the trim 31 only with friction or interference fit. In some versions, the first rib 19 can engage the trim 31 with friction or interference fit, and the second rib 27 can engage the trim 31 with mechanical and friction or interference fit.

Alternate embodiments of the starter strip 11 and the fastener flange 21 may be configured to engage the trim 31 on surfaces of the trim 31 that are not visible after installation. Versions of the trim 31 can require no fasteners to be installed therethrough. After installation, the first and second fastener hems 13, 23 can be configured to be parallel. Similarly, the first and second fastener hems 13, 23 may be configured to be co-planar after installation. In addition, the first and second fastener hems 13, 23 can be configured to be perpendicular to the starter flange 17 after installation.

In an example, one of the second ribs 27 may be located at an end of the fastener flange 21. In another example, a second one of the second ribs 27 may be located between said one of the second ribs 27 and a fastener hole 26 in the fastener flange 21. Versions of the second rib 27 can be thicker than the first rib 19, or the first rib 19 can be thicker than the second rib 27. The second rib 27 can be longer than the first rib 19, or the first rib 19 can be longer than the second rib 27. In other versions, the second rib 27 and the first rib 19 can be of substantially the same length. Versions of the second fastener hem 23 can be longer than the first fastener hem 17. In other versions, the fastener hem 23 can be shorter than or of substantially the same length as the first fastener hem 17.

Again referring to FIG. 1, the trim 31 may further comprise a thick flange or tab 37. The tab 37 can protrude from trim 31 on a side opposite the first slot 33. Versions of the tab 37 can define a pocket 38. The pocket 38 can be configured to receive a building product 39, such as siding, a widow frame, etc. Some versions of the fastener flange 21 can be configured to face a back B of the trim 31. Some versions of the starter strip 11 can be configured to face the back B and a side S of the trim 31.

Some embodiments of the fastener flange 21 may comprise a metallic material. Embodiments of the starter strip 21 may comprise a polymer. Embodiments of the trim 31 may comprise a polymer. The starter strip 21 and the trim 31 may comprise polyvinylchloride (PVC) or other suitable materials, such as metallic materials. In one embodiment, the trim 31 comprises a cellular PVC.

Figure 5:
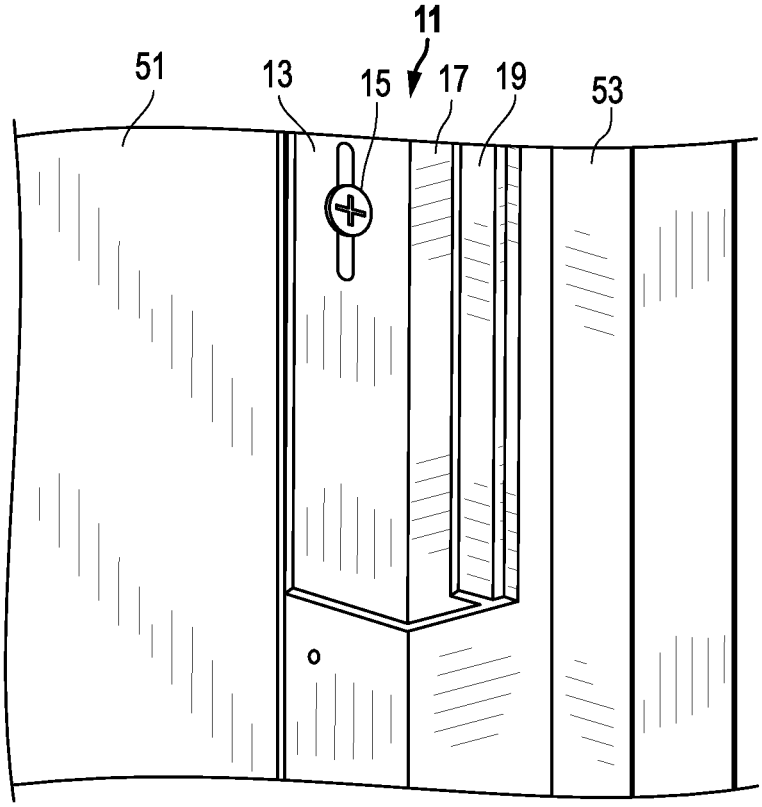
FIGS. 5-7 are isometric views depicting an embodiment of a method of installing a trim assembly.
Figure 6:
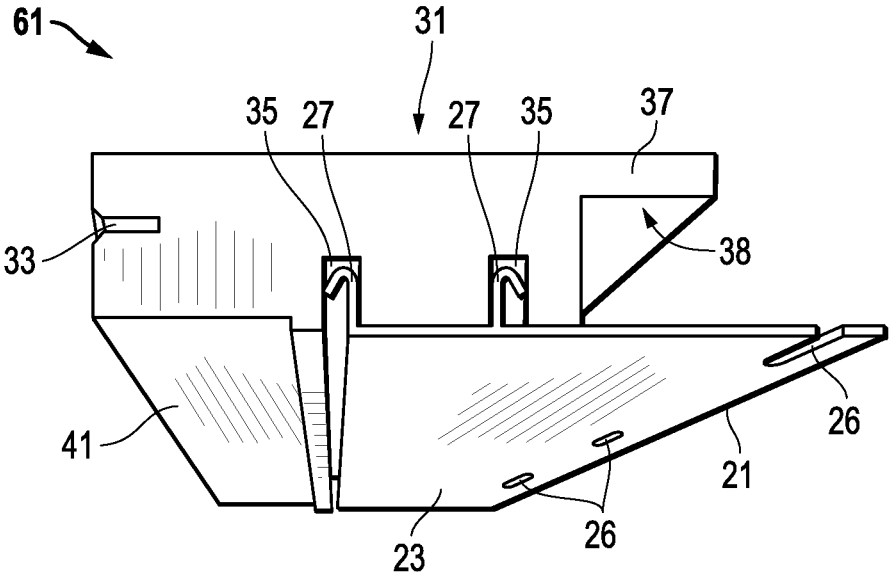
Figure 7:
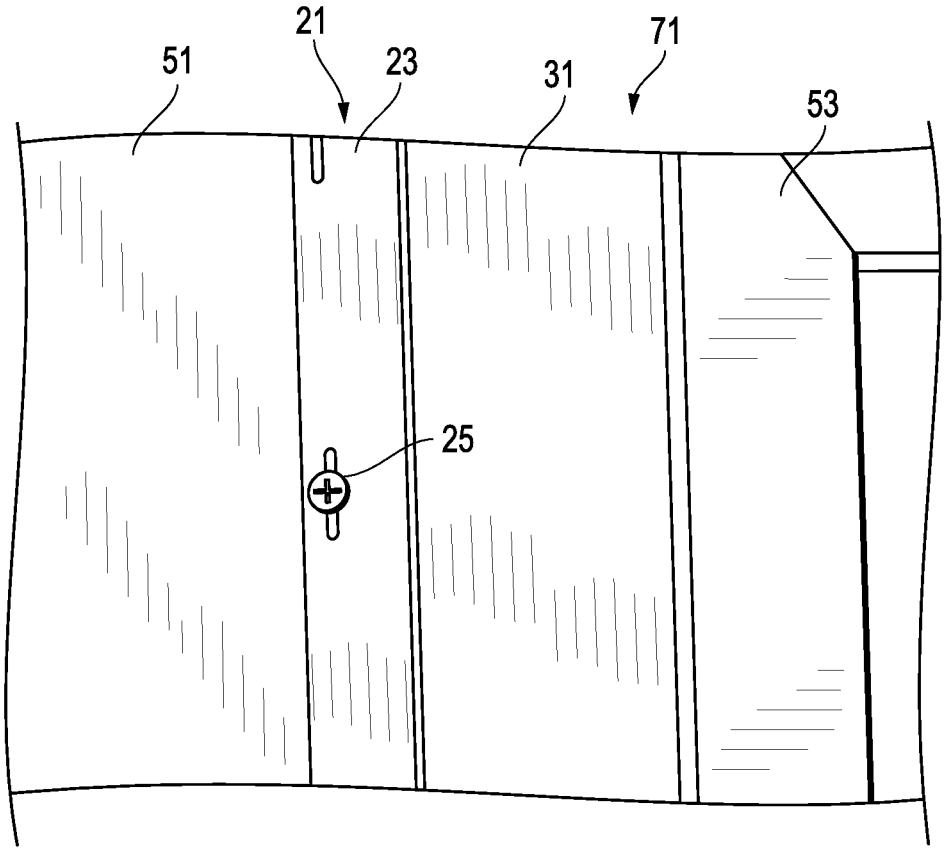

Embodiments of a method of installing trim also are disclosed. For example, as shown in FIGS. 5-7, the method may comprise installing a starter strip 11 with fasteners 15 at a location 53 on a building 51. The location may include, for example, a wall, window, door, gable, rake or any combination thereof.

The method may include installing a fastener flange 21 on a trim 31 without fasteners to form a pre-assembly 61 (FIG. 6). The method may further include installing the pre-assembly 61 on the starter strip 11 without fasteners (FIG. 1). In addition, the method may further include fastening the fastener flange 21 (FIG. 7) to the building 51 with fasteners 25 to form a final assembly 71. As depicted in FIG. 1, the method may further comprise installing a building product 39 (e.g., siding) around the final assembly 71 such that none of the fasteners 15, 25 are visible from an exterior of the final assembly 71.

In other embodiments, a trim assembly may comprise a starter strip having a first fastener hem configured to receive a fastener, a starter flange extending forward from the first fastener hem, and a first rib extending from the starter flange and substantially parallel to the first fastener hem. The trim assembly can include a fastener flange having a second fastener hem configured to receive a fastener, and a second rib extending from and substantially perpendicular to the second fastener hem. The trim assembly may further include a trim having a side with a first slot configured to receive the first rib and be mounted to the starter strip, and a back with a second slot configured to receive the second rib and be mounted to the fastener flange.

In still other embodiments, the trim assembly may include a starter strip having a first fastener hem and a first rib. The trim assembly can have a fastener flange having a second fastener hem and a second rib. The trim assembly may comprise a trim having a first slot configured to frictionally receive the first rib and be mounted to the starter strip, and a second slot configured to frictionally receive the second rib and be mounted to the fastener flange, and no fasteners join the trim to the starter strip and the fastener flange.

In yet another embodiment, a trim assembly can include a starter strip having a flange or first fastener hem configured to be mounted to a building with fasteners. The trim assembly can include a trim having a first slot configured to receive a portion of the starter strip by frictional engagement, the trim has a second fastener hem configured to be mounted to the building with fasteners, and no fasteners join the trim to the starter strip. Thus, in some versions, the trim includes both the trim 31 and fastener flange 21. In alternate versions, trim 31 and fastener flange 21 can be formed as a single, integral part, or they may be assembled to form a pre-assembly.

In some aspects, the trim assembly can be a three-component design that permits PVC trim installation around windows and doors without fastening through the visible face of the product. The design may include a starter strip that is installed first, followed by the trim, which has a nail flange and is inserted into the starter strip. The trim can be fastened through the nail flange which keeps the trim piece attached to the wall.

Still other embodiments may include one or more of the following items:

Item 1. A trim assembly, comprising:

a starter strip having a first fastener hem configured to receive a fastener, a starter flange extending from the first fastener hem, and a first rib extending from the starter flange;

a fastener flange having a second fastener hem configured to receive a second fastener, and a second rib extending from the second fastener hem; and a trim having a first slot configured to receive the first rib and be mounted to the starter strip, and a second slot configured to receive the second rib and be mounted to the fastener flange.

Item 2. The trim assembly of item 1, wherein the trim is mounted to the starter strip without fasteners, and the trim is mounted to the fastener flange without fasteners.

Item 3. The trim assembly of item 1, wherein the first and second ribs engage the trim with at least one of friction, interference fit, fasteners and adhesive.

Item 4. The trim assembly of item 1, wherein the first rib engages the trim with friction or interference fit, and the second rib engages the trim with mechanical and friction or interference fit.

Item 5. The trim assembly of item 1, wherein the starter strip and the fastener flange are configured to engage the trim on surfaces of the trim that are not visible after installation.

Item 6. The trim assembly of item 1, wherein the trim requires no fasteners to be installed therethrough.

Item 7. The trim assembly of item 1, wherein the first and second fastener hems are configured to be parallel after installation.

Item 8. The trim assembly of item 1, wherein the first and second fastener hems are configured to be co-planar after installation.

Item 9. The trim assembly of item 1, wherein the first and second fastener hems are configured to be perpendicular to the starter flange after installation.

Item 10. The trim assembly of item 1, wherein the trim further comprises a fastener recess configured to accommodate a head of the fastener of the starter strip.

Item 11. The trim assembly of item 10, wherein the fastener recess is located adjacent the second slot.

Item 12. The trim assembly of item 1, wherein the first rib is substantially planar.

Item 13. The trim assembly of item 1, wherein the second rib is non-planar.

Item 14. The trim assembly of item 1, wherein the second rib has a lip at a distal end thereof.

Item 15. The trim assembly of item 1, wherein the second rib comprises a plurality of second ribs.

Item 16. The trim assembly of item 15, wherein the plurality of second ribs extend in a same direction, but have opposed features at distal ends thereof.

Item 17. The trim assembly of item 16, wherein one of the second ribs is located at an end of the fastener flange, and a second one of the second ribs is located between said one of the second ribs and a fastener hole in the fastener flange.

Item 18. The trim assembly of item 1, wherein the second rib is thicker than the first rib, or the first rib is thicker than the second rib.

Item 19. The trim assembly of item 1, wherein the second rib is longer than the first rib, or the first rib is longer than the second rib.

Item 20. The trim assembly of item 1, wherein the second fastener hem is longer than the first fastener hem.

Item 21. The trim assembly of item 1, wherein the trim comprises a tab that protrudes therefrom on a side opposite the first slot.

Item 22. The trim assembly of item 21, wherein the tab defines a pocket that is configured to receive building product.

Item 23. The trim assembly of item 1, wherein the fastener flange is configured to face a back of the trim, and the starter strip is configured to face the back and a side of the trim.

Item 24. The trim assembly of item 1, wherein the fastener flange comprises a metallic material, and the starter strip and the trim comprise a polymer.

Item 25. The trim assembly of item 1, wherein the starter strip and the trim comprise polyvinylchloride (PVC) or a metallic material.

Item 26. The trim assembly of item 1, wherein the fasteners comprise nails, screws or both.

Item 27. A trim assembly, comprising:

a starter strip having a first fastener hem configured to receive a fastener, a starter flange extending forward from the first fastener hem, and a first rib extending from the starter flange and substantially parallel to the first fastener hem;

a fastener flange having a second fastener hem configured to receive a fastener, and a second rib extending from and substantially perpendicular to the second fastener hem; and a trim having a side with a first slot configured to receive the first rib and be mounted to the starter strip, and a back with a second slot configured to receive the second rib and be mounted to the fastener flange.

Item 28. A trim assembly, comprising:

a starter strip having a first fastener hem and a first rib;

a fastener flange having a second fastener hem and a second rib; and a trim having a first slot configured to frictionally receive the first rib and be mounted to the starter strip, and a second slot configured to frictionally receive the second rib and be mounted to the fastener flange, and no fasteners join the trim to the starter strip and the fastener flange.

Item 29. A method of installing trim, comprising:

installing a starter strip with fasteners on a building;

installing a fastener flange on a trim without fasteners to form a pre-assembly;

installing the pre-assembly on the starter strip without fasteners; and then fastening the fastener flange to the building with fasteners to form a final assembly.

Item 30. The method of item 29, further comprising installing siding around the final assembly such that none of the fasteners are visible from an exterior of the final assembly.

Item 31. The method of item 29, wherein the trim is installed at a location on the building, and the location is a window, door, gable, rake or any combination thereof.

Item 32. A trim assembly, comprising:

a starter strip having a first fastener hem configured to be mounted to a building with fasteners; and a trim having a first slot configured to receive a portion of the starter strip by frictional engagement, the trim has a second fastener hem configured to be mounted to the building with fasteners, and no fasteners join the trim to the starter strip.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A trim assembly, comprising:

three separate components comprising a starter strip, a fastener flange and a trim;

the starter strip comprises a first fastener hem configured to receive a fastener, a starter flange extending from the first fastener hem, and a first rib extending from the starter flange;

the fastener flange comprises a second fastener hem configured to receive a second fastener, a second rib extending from the fastener flange, and the fastener flange comprises a metallic material;

the trim comprises a first slot configured to receive the first rib and be mounted to the starter strip, a second slot configured to receive the second rib and be mounted to the fastener flange, the trim requires no fasteners to be installed therethrough, and the trim comprises a tab that protrudes therefrom on a side opposite the first slot, and in a same direction as the first rib;

the starter strip and the trim comprise a polymer or a metallic material; and the trim is configured to be mounted to the starter strip without fasteners, the trim is configured to be mounted to the fastener flange without fasteners, and the starter strip and the fastener flange are configured to engage the trim on surfaces of the trim that are not visible after installation.

2. The trim assembly of claim 1, wherein the second rib engages the trim with at least one of friction and interference fit.

3. The trim assembly of claim 1, wherein the second rib engages the trim with mechanical and friction or interference fit.

4. The trim assembly of claim 1, wherein the first and second fastener hems that receive the fasteners are configured to be parallel after installation.

5. The trim assembly of claim 1, wherein the first and second fastener hems that receive the fasteners are configured to be co-planar after installation.

6. The trim assembly of claim 1, wherein the first and second fastener hems are configured to be perpendicular to the starter flange after installation.

7. The trim assembly of claim 1, wherein the trim further comprises a fastener recess configured to accommodate a head of the fastener of the starter strip.

8. The trim assembly of claim 1, wherein the first rib is substantially planar.

9. The trim assembly of claim 1, wherein the second rib is non-planar.

10. The trim assembly of claim 1, wherein the second rib has a J-lip at a distal end thereof.

11. The trim assembly of claim 1, wherein the second rib comprises a plurality of second ribs, and the second slot comprises a plurality of second slots for receiving respective ones of the second ribs.

12. The trim assembly of claim 1, wherein the second rib is thicker than the first rib.

13. The trim assembly of claim 1, wherein the fastener flange is configured to face a back of the trim, and the starter strip is configured to face the back and a side of the trim.

14. A trim assembly, comprising:

a starter strip having a first fastener hem configured to receive a fastener, a starter flange extending from the first fastener hem, and a first rib extending from the starter flange;

a fastener flange having a second fastener hem configured to receive a second fastener, and a plurality of second ribs extending from the fastener flange;

a trim having a first slot configured to receive the first rib and be mounted to the starter strip, and a plurality of second slots, each of which is perpendicular to the first slot and configured to receive respective ones of the plurality of second ribs such that the trim is mounted to the fastener flange; and the starter strip and the fastener flange are configured to engage the trim on surfaces of the trim that are not visible after installation.

15. A trim assembly, comprising:

a starter strip having a first fastener hem configured to receive a fastener, a starter flange extending from the first fastener hem, and a first rib extending from the starter flange;

a fastener flange having a second fastener hem configured to receive a second fastener, and a plurality of second ribs extending from the fastener flange;

a trim having a first slot configured to receive the first rib and be mounted to the starter strip, a plurality of second slots configured to receive respective ones of the plurality of second ribs with an interference fit and be mounted to the fastener flange, and the trim comprises a tab that protrudes therefrom on a side opposite the first slot;

the first and second fastener hems are configured to be parallel after installation and wherein the starter strip, the fasteners flange and the trim are three separate components that are configured to form the trim assembly.

16. The trim assembly of claim 14, wherein the starter strip, the fastener flange and the trim are three separate components that are configured to be joined together to form the trim assembly.

17. The trim assembly of claim 14, wherein the trim comprises a tab that protrudes therefrom on a side opposite the first slot, and in a same direction as the first rib.

18. The trim assembly of claim 15, wherein the tab protrudes from the trim in a same direction as the first rib.

* * * * *